US005815791A

United States Patent [19]

Sporer

[11] Patent Number: 5,815,791

[45] Date of Patent: Sep. 29, 1998

[54] STRUCTURAL ELEMENT WITH BRAZED-ON FOIL MADE OF OXIDE DISPERSION-STRENGTHENED SINTERED IRON ALLOY AND PROCESS FOR THE MANUFACTURE THEREOF

[75] Inventor: Dieter Sporer, Tannheim, Austria

[73] Assignee: Schwarzkopf Technologies Corporation, New York, N.Y.

[21] Appl. No.: 618,828

[22] Filed: Mar. 20, 1996

[30] Foreign Application Priority Data

Mar. 25, 1995 [DE] Germany ..... 195 11 089.7

[51] Int. Cl.[6] ..... B22F 7/04

[52] U.S. Cl. ..... 419/8; 419/19; 419/20; 419/29

[58] Field of Search ..... 419/8, 19, 20, 419/29

[56] References Cited

U.S. PATENT DOCUMENTS

| | | | |
|---|---|---|---|
| 4,724,120 | 2/1988 | Bienvenu et al. | 419/8 |
| 4,844,863 | 7/1989 | Miyasaka et al. | 419/8 |
| 4,977,034 | 12/1990 | Wang | 428/548 |
| 5,010,050 | 4/1991 | Wüllenweber et al. | 502/301 |
| 5,017,437 | 5/1991 | Martin et al. | 428/558 |
| 5,318,214 | 6/1994 | Lucas, Jr. et al. | 228/121 |
| 5,523,170 | 6/1996 | Budinger et al. | 428/551 |
| 5,561,827 | 10/1996 | Reeves et al. | 419/5 |

OTHER PUBLICATIONS

John J. Fischer et al., "Mechanisch legierte Werkstoff fur industrielle Anwendungen", *Stahl U. Eisen* 112 (1992), Nr. 7.

T.J. Kelly, "Joining Mechanical Alloys For Fabrication", published in Proceedings of the 2nd International Conference on Oxide Dispersion Strengthened Superalloys by Mechanical Alloying, London, May 22–25, 1983.

G.H. Gessinger et al., "Mechanical Properties and Dampling Behaviour of an Oxide—Dispersion—Strengthened Ferritic Steel MA 956", Power Metallurgy International, vol. 10, No. 4 (1978).

M. Otsuka et al., "Tensile Deformation Behavior Of Oxide Dispersion Strengthened Ferritic Steel (Incoloy MA 957) At Elevated Temperature", The 33rd Japan Congress on Materials Research (March 1990).

*Primary Examiner*—Daniel J. Jenkins
*Attorney, Agent, or Firm*—Morgan & Finnegan, L.L.P.

[57] ABSTRACT

A process for manufacturing a structural element with brazed-on, bent or folded metal foil components having a foil thickness of less than 500 $\mu$m, made of an ODS sintered ferrous material. The sintered material is manufactured by mechanically alloying the basic powders, hot pressing and/or extruding, and subsequently hot-rolling, cold-rolling and final recrystalization annealing to form the sintered material into a foil having improved mechanical strength properties. After the cold-rolling step, the foil material is annealed so that the foil may be thereafter bent and folded at room temperature. The bent and/or folded foil is recrystallization-annealed at a temperature between 1100° and 1300° C. during 3–600 minutes, simultaneously with a brazing operation, in a single process step.

8 Claims, No Drawings

STRUCTURAL ELEMENT WITH BRAZED-ON FOIL MADE OF OXIDE DISPERSION-STRENGTHENED SINTERED IRON ALLOY AND PROCESS FOR THE MANUFACTURE THEREOF

BACKGROUND OF INVENTION

1. Field of the Invention

The present invention relates to a process for manufacturing a structural element with brazed-on, bent or folded metal foil elements having a foil thickness of less than 500 μm, made of an oxide dispersion-strengthened (ODS) sintered ferrous material, wherein the sintered material is manufactured by mechanically alloying the basic powders, hot pressing and/or extruding, and is finished by subsequent hot-rolling, cold-rolling and final recrystallization annealing to form it into a foil and, at the same time, improve its mechanical strength properties.

2. Description of the prior art

Mechanically alloyed ODS sintered materials are utilized for specific components in turbines and equipment where particularly high heat strength and above all high corrosion resistance against hot gases are essential.

Use of these materials in new application areas has been limited because the unique properties of these materials can only be achieved through particularly expensive manufacturing processes. As a result, these materials are available only in limited shapes, can only be machined to a limited degree and, even using specialized process steps, can be joined with similar or other materials only to a limited extent without significant deterioration of quality.

Previously, the manufacture of such materials with the desirable strength and corrosion properties that can typically be attained has been preferably carried out in a largely obligatory sequence consisting of mechanically alloying the pre-blended components of the alloy, followed by hot pressing and/or strang pressing of the alloy powder. In case the semi-finished material is to be shipped in rod form, the material was then hot-rolled in an additional sequence of steps, after which a final recrystallization annealing step was applied in order to increase the grain size of the material. The process of recrystallization annealing at the usual temperatures of approximately 1330° to 1500° C. generally resulted in a significant increase in the heat strength of the material due to the formation of a coarse-grained structure.

If the material was to be processed into sheet metal, the hot-rolling process was followed by a multi-step cold-rolling treatment, again followed by a final recrystallization annealing process. This standard method of manufacture is described, for instance, in the article "Mechanically Alloyed Materials For Industrial Applications", John J. Fischer et al., *Stahl und Eisen* 112 (1992), No. 7, p. 77 and following.

The above-mentioned article states that thin metal sheets made of mechanically alloyed sintered ferritic materials were manufactured down to a foil thickness of 0.1 mm, and that particularly thin sheets made of this material exhibit a brittleness next to their high strength which does not allow bending and folding it at room temperature with satisfactory results, due to the danger of cracking and breaking. To avoid this problem, mention is made of heating the thin sheet to a temperature above the transition temperature from the brittle to the ductile state, which is not very satisfactory in practice. It means that shaping and folding of the thin sheet must be carried out at elevated temperatures of at least 100° C.

It has also been repeatedly pointed out in the literature that mechanically alloyed ODS materials on an iron and nickel basis have poor welding and brazing properties. The reason lies in the stable oxide layers on the material surface. These are unavoidable because of the processing steps that are used. The document "Proceedings of the 2nd International Conference on Oxide Dispersion Strengthened Superalloys by Mechanical Alloying", London, May 22–25, 1983, pages 129 and following, already pointed out the need for careful preparation of the materials prior to brazing or welding. Mechanical grinding of the brazing surfaces was cited as an adequate preparation for vacuum hard brazing.

In addition, a recommendation was made in the aforementioned article to protect the ground surfaces immediately against new oxidation until brazing, such as by submersion in alcohol. The article describes nickel and cobalt-based brazing compounds, among others, as brazing agents successfully utilized with such materials. Attention is called to the danger of deteriorating the desirable strength and corrosion properties of these materials due to joining. Likewise, processes and brazing compounds that are successfully used for joining metal sheets of 2.5 mm thickness cannot be used, according to the article, for joining thicker sheets. Laser, electron beam and resistance spot welding can be considered for joining very thin foils, but adequate brazing methods are not mentioned.

SUMMARY OF THE INVENTION

Accordingly, an objective of the present invention is to make available a process for manufacturing a structural element with brazed-on, bent or folded metal foil components having a foil thickness of less than 500 μm, made of an ODS sintered ferrous material, wherein the sintered material is manufactured by mechanically alloying the basic powders, hot pressing and/or extruding, and is finished by subsequent hot-rolling, cold-rolling and final recrystallization annealing to form the sintered material into a foil and, at the same time, improve the sintered material's mechanical strength properties.

To date, it has not been possible to satisfactorily manufacture brazed elements of this type. The present invention, however, provides a process by which very thin foils can be folded and bent at room temperature without cracking, and can be subsequently brazed without losing the good corrosion and mechanical strength properties of conventional ODS ferrous materials in the finished element.

According to the present invention, this and other objectives are attained through a process by which the manufacture of the foil material is interrupted by an annealing step after cold-rolling, and according to which the foil, after subsequent bending or folding at room temperature, is recrystallization-annealed at temperatures between 1100° and 1300° C. during 3–600 minutes, simultaneously with the brazing operation, in a single process step.

The process according to the present invention is thus a significant modification of the manufacturing processes that have to date been considered indispensable for achieving the superior properties of the material.

The foregoing specific object and advantage of the invention is illustrative of those which can be achieved by the present invention and is not intended to be exhaustive or limiting of the possible advantages which can be realized. Thus, this and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

DETAILED DESCRIPTION OF THE INVENTION

The present invention provides a process by which very thin foils can be folded and bent at room temperature without cracking, and can be subsequently brazed without losing the good corrosion and mechanical strength properties of conventional ODS ferrous materials in the finished element.

According to the present invention, a structural element with brazed-on, bent or folded metal foil components having a foil thickness of less than 500 $\mu$m, made of an ODS sintered ferrous material is manufactured by a process wherein the sintered material is manufactured by mechanically alloying the basic powders, hot pressing and/or extruding, and is finished by subsequent hot-rolling, cold-rolling and final recrystallization annealing to form the sintered material into a foil and, at the same time, improve the sintered material's mechanical strength properties.

According to the present invention, the process of manufacturing the foil material is interrupted by an annealing step after cold-rolling and, after subsequent bending or folding at room temperature, the foil material is recrystallization-annealed at temperatures between 1100° and 1300° C. during 3–600 minutes, simultaneously with the brazing operation, in a single process step.

The annealing step subsequent to hot and cold-rolling of the feed material from these materials as such had already been tested in the past. However, the results, which were obtained with massive samples and not with foils, were not very encouraging. In the usual temperature range below the recrystallization temperature, neither a reduction of micro-hardness and strength nor a pronounced increase in ductility were found ("Mechanical Properties and Damping Behavior of an Oxide-Dispersion-Strengthened Ferritic Steel MA 956", G. H. Gassinger and O. Mercier, Powder Met. Int. 10.4 (1978); "Tensile Deformation Behavior of Oxide Dispersion Strengthened Ferritic Steel at Elevated Temperature", M. Otsuka and K. Watanabe, The 33rd Japan Congress on Materials Research, March 1990).

It was therefore surprising and unpredictable that the annealing of very thin foils would result in such a great increase in ductility, permitting subsequent bending and folding of such foils at room temperature, i.e. without previous heating, without any problems, without causing tears in the foil and without leading to a permanent decrease in the high strength and good corrosion resistance of the final product during the subsequent process sequence in accordance with the invention. The annealing process is conducted during 30 to 300 minutes at 600° to 1050° C. under a protective gas, in an $H_2$ atmosphere or in a high vacuum.

Surprisingly, the foils can be brazed using a wide spectrum of known brazing compounds. Whereas mechanically alloyed ODS sintered ferrous materials are usually recrystallization annealed at least 1330° C., foils produced in accordance with the present invention could be brazed onto a base material at a temperature as low as 1100° C., using appropriate brazing compounds, and could also be recrystallized in their entirety at the same time. Brazing thin foils, if done by the process according to the present invention, therefore requires none of the well-known aggressive brazing compounds, which weaken individual components of the sintered material to be brazed and thus result in permanent deterioration of material properties, which cannot be reversed by means of a recrystallization process.

Brazing compounds that have been used with particular success include conventional materials on a cobalt basis, such as an alloy of CoCrNiSiW, as well as nickel-chromium-based materials, such as NiCrSi, NiCrSiMn, NiCrB and NiCrSiBFeW, but also ferrous brazing compounds, such as FeSiB, and titanium-based materials.

When applying the process according to the present invention, it has proven useful to mechanically remove impurities from the areas to be joined, particularly oxide layers attached to the surface, using up-to-date techniques. This cleaning step is preferably carried out by way of an interruption of the cold-rolling process comprising several rolling treatments. The foils must retain sufficient stiffness for the grinding treatment. However, this is not the case with foils of 500 $\mu$m or less. The high surface quality achieved in this manner can be maintained up to the brazing operation if annealing takes place in a vacuum or under a non-oxidizing protective gas cover.

With a view toward unimpeded brazing of the foils while annealing simultaneously takes place, it is advantageous to reduce the surface roughness of the foil subsequent to annealing down to the same value as before annealing by means of an additional cold-rolling run.

Among the ferrous ODS sintered materials, those with an aluminum content of between 3 and 10% by weight have proven acceptable for the process according to the present invention, promoting the formation of aluminum oxide layers on the surface due to the aluminum component. A preferred ferrous ODS sintering material has the following composition: 6–30% by weight of Cr, 3–10% by weight of Al, up to 5% by weight of Ti, up to 10% by weight of Mo or W, up to 5% by weight of Ta, 0.15–2% by weight of oxide particles of the metals yttrium, aluminum, lanthanum and/or zirconium, finely dispersed in the matrix and not reacting with it, with iron as the remainder.

The process according to the present invention is illustrated below by means of the following implementation example.

EXAMPLE

To carry out the process according to the present invention, a powder mixture of the following chemical composition was prepared, with the usual grain size distribution for producing such materials:

19% by weight of chromium, 5.5% by weight of aluminum, 0.5% by weight of titanium, 0.5% by weight of yttrium oxide, and the remainder iron.

Applying the process parameters as described above, the powder was first mechanically alloyed, then hot-pressed and further processed by hot-rolling and cold-rolling into foil ribbons of 0.10 mm thickness. These ribbons had very poor ductility and broke during an attempt to fold them.

The foils were then annealed at 780° C. during 60 minutes. Even foils wound into a spiral were annealed without problems and without adjoining foil surfaces sticking together.

Investigation of a test sample cut from the foil confirmed a strong decrease of the strength value after cold-rolling from 1612 to 1240 MPa, of the 0.2% elongation limit from 1575 to 1187 MPa, of the Vickers hardness from 428 to 381 hardness units, as well as a simultaneous rise in A5ductility from 0.4to the surprisingly high value of 4.1%.

Accordingly, it was possible to fold and bend the annealed foil at room temperature without cracks, in the direction of rolling as well as at right angles to it. It was possible to process foils pre-treated in this manner into corrugated sheet structures of several meters in length at room temperature without any problems.

The foils which were manufactured, bent and folded in this manner exhibited very good weldability and good brazability onto a base plate of nickel based alloys that were mixed-crystal hardened or precipitation hardened. Of equal importance is a good weldability of individual, bent structural components to each other and a good brazability of these welded structural components onto the base plate. Equally favorable results were obtained with brazing onto iron-based as well as nickel-based ODS alloys. A cobalt-nickel-chromium-silicon brazing compound was used. The element consisting of the base plate and the foil structure was evenly heated to 1140° C. and left at this temperature for 75 minutes.

After cooling down the element, investigation confirmed that a mechanically solid brazing of the components of the element had taken place which did not significantly affect the existing structures of the materials, and that, at the same time, a complete recrystallization of the foil material from a very finegrained structure to a coarse-grained structure had taken place, increasing the hot strength of the material.

Application of the process according to the invention is not limited to the example cited above. An important area of application for elements produced by the process at hand is in aeronautics and space technology, particularly in the form of annular gaskets in the blade area of turbines, or as heat shield tiles. Other applications lie in the area of metallic catalysts for emission purification in automobiles, and in the area of heat sinks for regenerative combustion systems.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

What is claimed is:

1. A process for manufacturing a structural element with brazed-on, bent or folded metal foil components having a foil thickness of less than 500 $\mu$m, made of an ODS sintered ferrous material, said process comprising the steps of manufacturing the sintered foil material by mechanically alloying basic powders, hot pressing and extruding or hot pressing or extruding, and subsequently hot-rolling, cold-rolling and final recrystallization annealing to form the foil having improved mechanical strength properties, wherein said process further comprises the steps of annealing the foil after said cold-rolling step, subsequently bending or folding the foil at room temperature, and recrystallization-annealing the foil in a single process step, simultaneously with a brazing operation, at a temperature between 1100° and 1330° C. during 3–600 minutes.

2. The process for manufacturing an element according to claim 1, further comprising the step of mechanically removing impurities and reaction products from the surface of the foil in advance of or as an interruption of the cold-rolling process comprising several cold-rolling runs.

3. The process for manufacturing an element according to claim 1, further comprising at least one additional cold-rolling run subsequent to the annealing process and preceding the folding of the foil.

4. The process for manufacturing an element according to claim 1, wherein the annealing step is carried out during 30–300 minutes at 600°–1050° C. in a protective gas atmosphere, in an $H_2$ atmosphere or in a high vacuum.

5. The process for manufacturing an element according to claim 1, wherein a cobalt-based alloy, such as CoCrNiSiW, is used as a brazing compound.

6. The process for manufacturing an element according to claim 1, wherein nickel-chromium alloys such as NiCrSi, NiCrSiMn, NiCrB and NiCrSiBFeW, or iron-based alloys such as FeSiB, or titanium-based alloys are used as a brazing compound.

7. The process for manufacturing an element according to claim 1, wherein the brazing of the foil at lateral edges of the foil and the recrystallization annealing of the foil material are carried out successively through time zone by zone.

8. The process for manufacturing an element according to claim 1, wherein the ODS sintered ferrous material comprises the following alloy composition:

6–30% by weight of Cr, 3–10% by weight of Al, up to 5% by weight of Ti, up to 10% by weight of Mo or W, up to 5% by weight of Ta, 0.15–2% by weight of oxide particles of the metals yttrium, aluminum, lanthanum and/or zirconium, finely dispersed in the matrix and not reacting with it, with iron as the remainder.

* * * * *